US007445012B2

(12) United States Patent
Mukai

(10) Patent No.: US 7,445,012 B2
(45) Date of Patent: Nov. 4, 2008

(54) HAIR IRON

(76) Inventor: Takashi Mukai, 2-2-9 Tachibana, 2-chome, Sumida-ku, Tokyo (JP) 131-0043

( * ) Notice: Subject to any disclaimer, the term of this patent is extended or adjusted under 35 U.S.C. 154(b) by 0 days.

(21) Appl. No.: 11/402,731

(22) Filed: Apr. 12, 2006

(65) Prior Publication Data

US 2007/0240731 A1 Oct. 18, 2007

(51) Int. Cl.
*A45D 1/00* (2006.01)
*A45D 1/04* (2006.01)

(52) U.S. Cl. ..... 132/224; 219/222

(58) Field of Classification Search ..... 132/224, 132/225, 223, 229, 232, 269; 219/222
See application file for complete search history.

(56) References Cited

U.S. PATENT DOCUMENTS 6,053,178 A * 4/2000 Todd ..... 132/208
6,278,086 B1 * 8/2001 Janouch et al. ..... 219/222
2006/0150996 A1 * 7/2006 Lun et al. ..... 132/224
2006/0207625 A1 * 9/2006 Chan ..... 132/224

FOREIGN PATENT DOCUMENTS

GB 2252727 A * 8/1992
JP 2001-137038 5/2001

* cited by examiner

*Primary Examiner*—Robyn Doan
(74) *Attorney, Agent, or Firm*—Jordan and Hamburg LL

(57) ABSTRACT

A hair iron comprises of a pair of holding arms pivotally articulated at one end, operating holding action by grasping the hand hold part placed in the center of the holding arms. A pair of reformation plates is placed on the top side of the two arms with their reformation plane facing each other for straightening hair by holding hair in between the reformation plates with heat added by the heat plate. The reformation plates are movably held on the holding arms with a plurality of coil springs. The plurality of coil springs also pushes the reformation plates each other to their facing direction to control the state of holding hair. Thus the control of the contact pressure and also the control of the uniformity of the contact pressure over the reformation plane 87 can be facilitated.

11 Claims, 14 Drawing Sheets

Prior Art

Prior Art

HAIR IRON

BACKGROUND OF THE INVENTION

1. Field of the Invention

The present invention relates to a hair iron device for reforming hair.

2. Description of Related Art

An example of a hair iron device shown in FIGS. 9A and 9B is disclosed in Japanese Unexamined Patent Application Publication No. 2001-137038. FIG. 9A is an entire view of the hair iron. FIG. 9B is a cross-sectional view of the hair iron.

As shown in FIGS. 9A and 9B, the hair iron 201 has a main body 203 and a power supply code 205 connected to the main body 203. A thermal controller 207 is placed in the midway of the power supply code 205. A power plug 209 is connected to an end of the power supply code 205.

The main body 203 of the hair iron 201 comprises a pair of arms 211 and 213 made of resin for holding hair. These two arms 211 and 213 are pivotally articulated at one end of the arms 215 and 217. A pair of reformation plates 223 and 225 is movably held on the arms facing each other. Back of the reformation plate 223, a board spring 227 is placed to push the reformation plate 223 toward the other reformation plate 225.

When the power plug 209 is connected to the power outlet, the reformation plates 223 and 225 are heated with the control of the thermal controller 207. By holding and sliding hair in between the heated reformation plates 223 and 225, hair is straightened. During the hair straightening process, the reformation plates are automatically aligned parallel because of the effect of pushing by the spring 217.

Therefore unevenness of ironing caused by the partial touch of the reformation plates 223 and 225 to hair is prevented. Thus the hair iron 201 can easily straighten either of naturally or artificially curled hair.

However, the method of using the single spring 227 of the prior art cannot make the contact pressure uniform between the reformation plates 223 and 225 and also cannot easily control the contact pressure over the contact plane for example setting stronger pressure at the top side to the base side relatively or vice versa.

SUMMARY OF THE INVENTION

The object of the present invention is to facilitate controlling the contact pressure between reformation plates.

The present invention is most characterized by pushing reformation plate member comprised of two or more elastic bodies to facilitate controlling contact pressure of the reformation plates.

The present invention of the hair iron comprises pushing reformation plates member comprised of two or more elastic bodies. Therefore, the facing reformation plates contact pressure is easily controlled by varying the spring coefficient of the elastic bodies.

The object of controlling the contact pressure of the reformation plates is achieved by two or more elastic bodies.

DETAILED DESCRIPTION OF EMBODIMENTS

Figure 1:
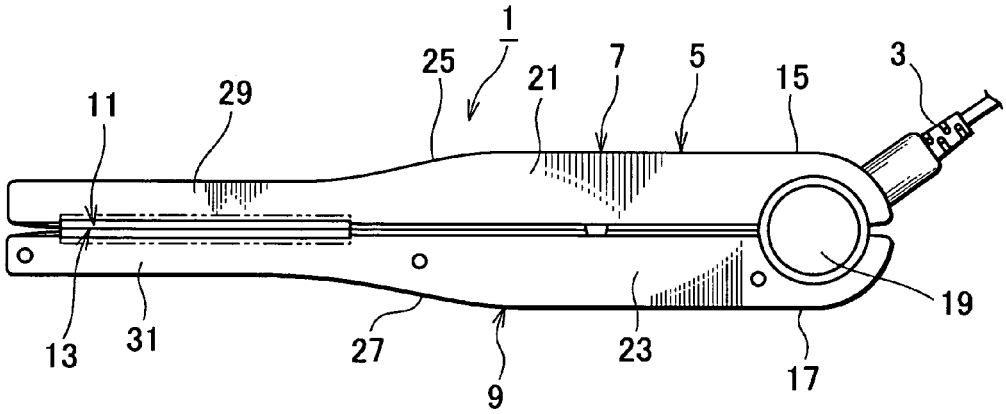
FIG. 1 is a front view of a hair iron device embodying this invention.

A hair iron device 1 of an example 1 of the present invention is comprised of two arms 7 and 9. The two arms 7 and 9 including hand holding parts 21 and 23 are articulated at their base end 15 and 17 to make the top side corresponding to the other end of the arms 7 and 9 moving to closed position. The two arms 7 and 9 operate holding action of the top side by grasping the hand holding part 21 and 23. The arms 7 and 9 have a pair of reformation plates 11 and 13. The pair of reformation plates 11 and 13 is placed at the top part 29 and 31 of the two arms 7 and 9 to face each other. The reformation plates 11 and 13 each includes heated thermal plate portion 67. The heated thermal plate portion 67 has a reformation plane 87 serving as a surface of the reformation plate. The reformation planes 87 of the reformation plates 11 and 13 are contacted with each other at the closed position. The heated thermal plate portion 67 of the reformation plates 11 and 13 holds hair at the reformation plane 87 by the holding action for the object of straightening or waving hair i.e., reforming hair. At least one of the reformation plates 11 and 13 is movably held at some range on the holding arm 7 and 9. According this embodiment, both of the reformation plates 11 and 13 is movably. The hair iron device 1 has pushing reformation plate member E. The pushing reformation plate member E is comprised of two or more elastic bodies placed on the two arms 7 and 9 to push the reformation plates 11 and 13 to control elastically hair holding pressure.

Figure 4:
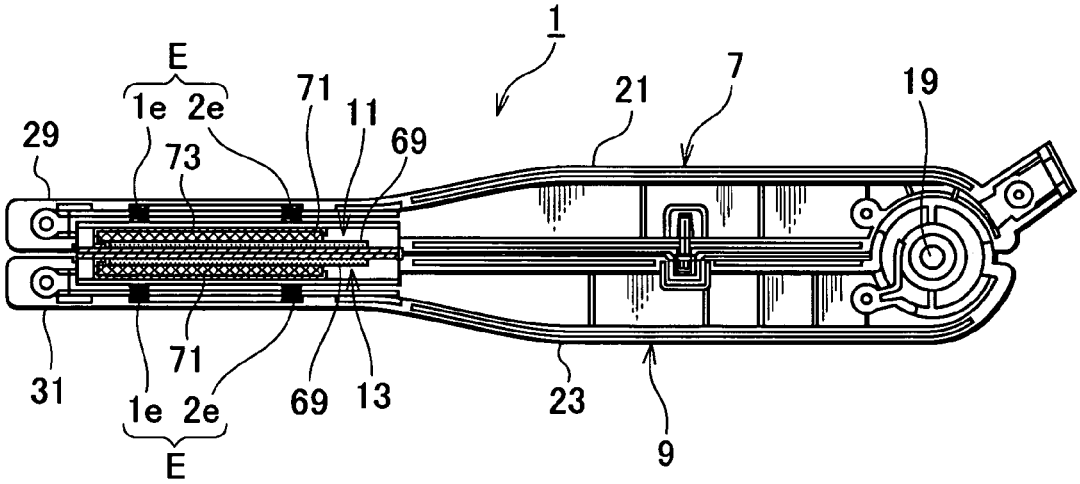
FIG. 4 is a cross-sectional view along the axis of the device shown in FIG. 1 showing its internal structure.
Figure 5:
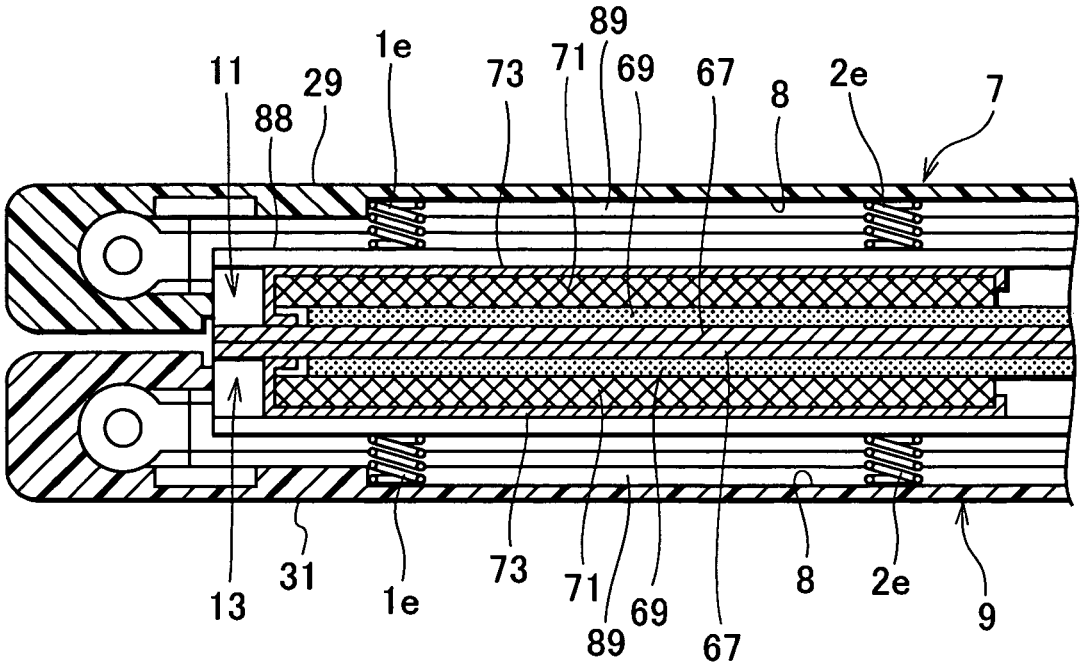
FIG. 5 is an enlarged cross-sectional view of the device shown in FIG. 1.
Figure 6:
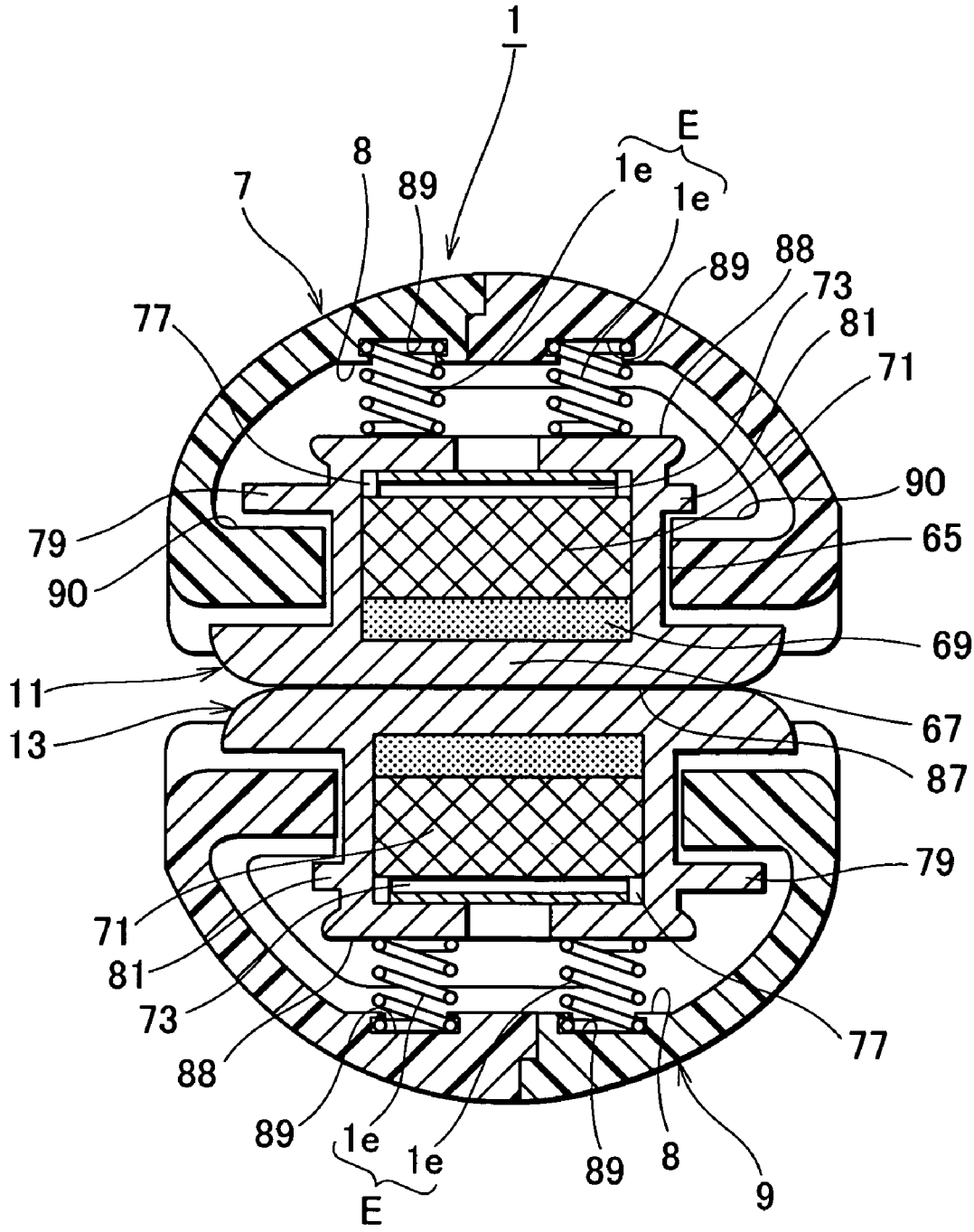
FIG. 6 is a cross-sectional view perpendicular to the axis of the device shown in FIG. 1 showing internal structure.

For this embodiment, the elastic bodies configuring the pushing reformation plate member E are comprised of a set of four coil springs 1*e* and 2*e*. As shown in FIG. 4, FIG. 5 and FIG. 6, the coil springs 1*e* and 2*e* are held to push the reformation plates 11 and 13 so that the reformation plates are pushed each other and contacted at the reformation plane 87 at the closed position. The coil springs 1*e* are placed at the outer circle side and the coil springs 2*e* are placed at the inner circle side of the pivot axis 19.

The structure of the reformation plates 11 and 13 and their surroundings are similar, thus to make the explanation simple the following explanation is focused on the arm 7.

Figure 7A:
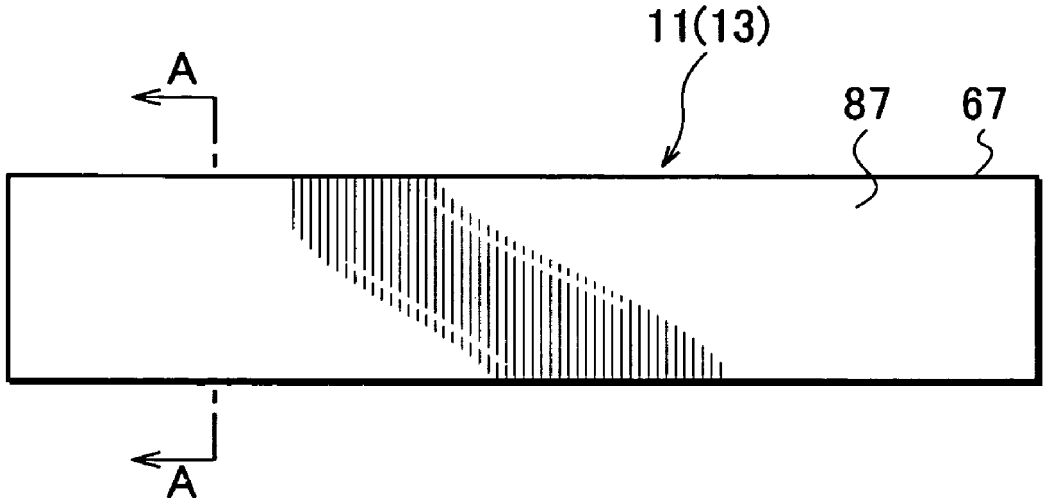
FIG. 7A is a bottom view of the reformation plate of the device shown in FIG. 1.
Figure 7B:
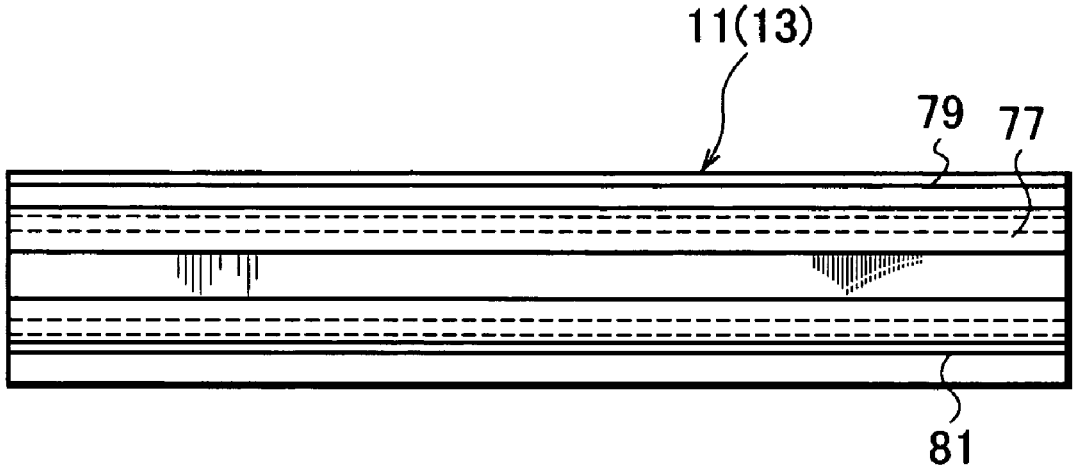
FIG. 7B is a top view of the reformation plate of the device shown in FIG. 1.
Figure 7C:
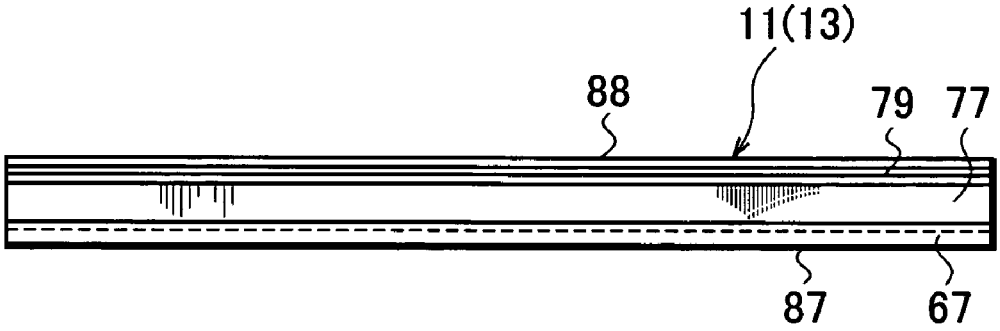
FIG. 7C is a side view of the reformation plate of the device shown in FIG. 1.
Figure 7D:
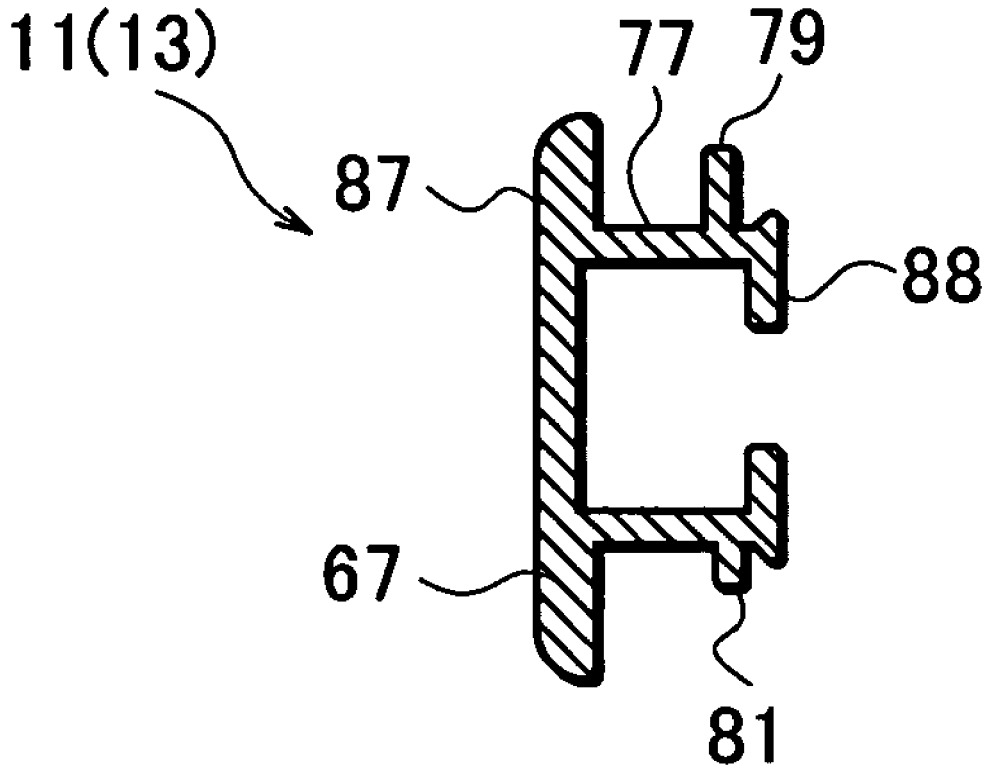
FIG. 7D is a cross-sectional view along the line A-A of FIG. 7A.

As shown in FIG. 7A the reformation plane 87 of the reformation plate 11 is almost rectangle shape. The coil springs 1*e* and 2*e* configuring the elastic bodies are placed in between the inside of the top part 29 of the arm 7 and the reformation plate 11 at the four corners of a top plane 88 of the reformation plate 11.

The coil springs 1*e* and 2*e* are fixed on the both of the top plane 88 of the reformation plate 11 and the arm 7 by engagement or bonding. A slit 8 is formed in between the reformation plate engagement shoulder 79, 81 and positioning plane 90 of the arm 7 so that the reformation plate is movable freely for a certain range. Therefore by varying the height of the coil springs 1*e* and 2*e* that is the axis length of the coil springs, it is possible to set the open state of the reformation planes 87 parallel just before their contact of the planes 87.

In the above configuration, it is possible to set all the coil springs 1*e* and 2*e* axis length same or to set the 1*e* axis length longer than 2*e* axis length or vice versa. By the above mentioned varied settings of the coil springs length, it is possible to set the both of the contact planes 87 facing not parallel and contacting the closer side of the pivot 19 touch first or the other side of the pivot 19 touch first.

The engagement of the coil springs 1*e* and 2*e* to the arm 7 shown in FIG. 6 are exemplified as follows. A slit 8 with a ditch 89 along the arm axis is installed on the arm 7. The first turn of the coil springs 1*e* and 2*e* is engaged to the ditch 89 of the slit 8. This engagement action can be done at the installation of the reformation plate 11 to the arm 7 after the installation of the coil springs 1*e* and 2*e* to the reformation plate 11. The coil springs le and 2*e* are fixed onto the reformation plate 11 by the similar slit structure, bonding or welding of metal.

As stated above, the reformation plane 87 of the reformation plate 11 is formed almost rectangle. The coil springs 1*e* and 2*e* configuring the elastic bodies are placed on each corner of the reformation plate. Therefore the lines between the coil springs positions form a parallelogram. Thus the contact pressure of the pair of the reformation plane 87 facing each other can be easily controlled to be uniform over the entire plane. As a result, unevenness of ironing caused of partial contact can be prevented.

Also, in the example 1, by setting the spring coefficient of the coil springs 1*e* and 2*e* appropriate, the contact pressure of the reformation plane 87 is set uniform. Because the holding arms 7 and 9 are rotating on the axis 19, the shrinking amount of the coil springs 1*e* and 2*e* after the contact of the reformation plane 87 are different. To make the contact pressure uniform over the reformation plane 87 even the shrinking amount of 1*e* and 2*e* are different, the spring coefficient of the coil springs 1*e* and 2*e* are set different. For example, the coil springs 2*e* are closer to the pivot axis 19 to the coil springs 1*e*, thus the shrinking amount of the coil springs 2*e* are larger. To make the contact pressure uniform over the contact plane 87, the spring coefficient of the coil springs 2*e* is set smaller than the spring coefficient of the coil springs 1*e*.

However, the setting of the contact pressure of the reformation plane 87 can be intentionally set non-uniform. The contact pressure of the pivot axis side can be set higher than the top side. Or the contact pressure of the top side can be set higher than the pivot axis side. As a varied case it is also possible to set all coil springs 1*e* and 2*e* comprises the same spring coefficient.

As stated above, the example 1 is comprised of reformation plate pushing member made of elastic bodies configuring of a plurality of coil springs, but the elastic bodies are not restricted to the coil springs. As varied case, the elastic bodies are exemplified with rubber columns.

The reformation plates 11 and 13 are made of aluminum to accomplish light weight. In the example 1, the reformation plates 11 and 13 are coated by titanium at the very least. The titanium coating sterilizes the surface of the coating plane, thus the proliferation of miscellaneous germs is controlled at the surface. As a result, the titanium coating prevents increase of friction coefficient caused of adhesion of the miscellaneous germs and keeps good slides of hair in between the reformation plane 87, thus the hair straightening operation can be efficiently done.

In the next, the entire structure of the above-mentioned hair iron 1 of the example 1 is explained in detail with FIG. 1 to 8.

The hair iron 1 is comprised of a main body 5 with a connected power cord 3. The power cord 3 can be connected with a thermal controller and a power plug.

The main body 5 of the hair iron is comprised of the pair of the holding arms 7 and 9 with the pair of the reformation plates 11 and 13. The holding arms 7and 9 are made of resin for instance C-polyester engineering plastic with a value of linear coefficient of expansion 8.8×10−5 cm/cm/C. The holding arms are articulated at the pivot axis.

Figure 2:
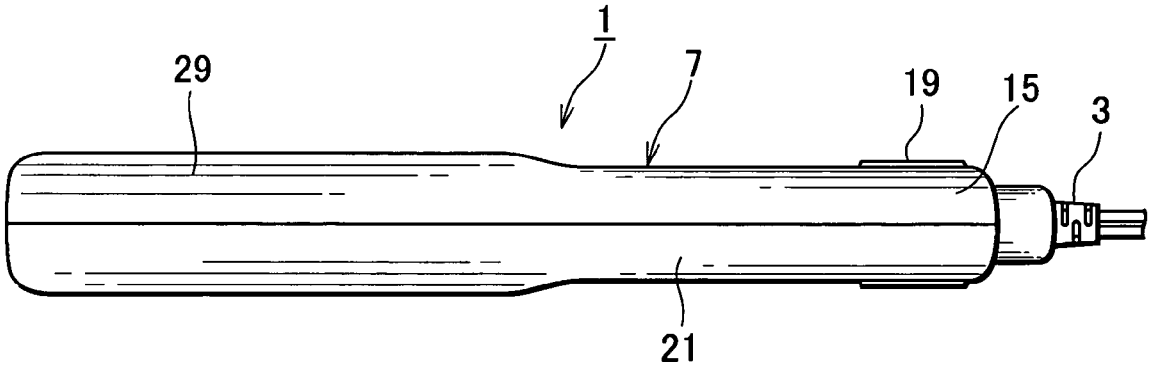
FIG. 2 is a plan view of the device shown in FIG. 1.
Figure 3:
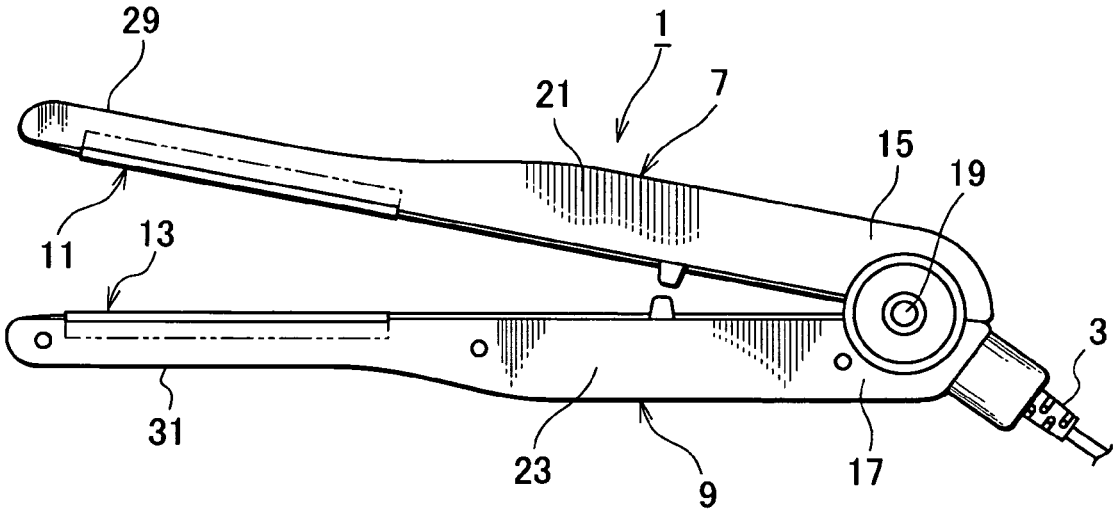
FIG. 3 is a front view of the device shown in FIG. 1 showing the arms in open position.

In the center of the holding arms 7 and 9, hand holding part 21 and 23 are installed. As shown in FIG. 1, FIG. 2 and FIG. 3, the hand holding part 21 and 23 are formed relatively thicker through to the base part 15 and 17 to make it easier to hold the main body by hand.

At the top side of the hand-hold part 21 and 23 has emphasis points 25 and 27 made of slope shoulders. As shown in FIG. 1 the top part of the hair iron is thinner than its base part. The emphasis points 25 and 27 are designed to be held with a thumb and an index finger so that the hair iron is easily held when hand-hold part 21 and 23 are held by a palm and other fingers.

As stated above, the holding arms 7 and 9 are pivotally articulated at the base side 15 and 17 and then the top side 21 and 23 operate holding action when the hand-hold part 21 and 23 are grasped.

The structure of the holding arms 7 and 9 is shown in an enlarged cross sectional view of FIG. 5 and a cross sectional view of FIG. 6. To make the explanation simple, the following description mainly explains the top side 29 of the holding arm 7, because the top side 29 and 31 of the holding arms are symmetrical.

As shown in FIG. 5 and FIG. 6, a reformation plate support hole 65 is formed to hold the reformation plate 11 movably toward the facing reformation plate 13. Thus the reformation plates 11 and 13 are placed at the top side 29 and 31 of the holding arms 7 and 9 facing each other and hold hair by the grasping action of the arms 7 and 9 to straighten hair with heat.

The reformation plate 11 is made of mainly aluminum for light weight purpose. As shown in FIG. 5 and FIG. 6, the reformation plate 11 comprises of a heat plate 67, a ceramic heater 69, a magnet plate 71 and a magnet pushing member 73. The reformation plate 11 is pushed by the reformation plate pushing member E.

The heat plate 67 is configured of the reformation plate 87 and is coated by titanium. The titanium coating facilitate good slide of hair between the reformation planes 87 for straightening hair process and promote efficiency of the process. Moreover the titanium coating prevents unexpected catch of hair and also sterilization effect can be expected.

As shown in FIG. 6, two engagement shoulders 79 and 81 are installed at the wall of the reformation plate 11. The engagement shoulders 79 and 81 limits the projection movement of the reformation plane 67 from the arm 7 at a certain range. An accommodation space 77 is installed inside of the reformation plate and the ceramic heater 69, the magnet plate 71 and the magnet pushing member 73 are placed in the accommodation space 77. Thus the reformation plate 11 and 13 comprises the accommodation space 77, and the magnet plate 71 configuring the magnet and a spring 73 configuring the magnet pushing member 73 pushing the magnet plate 71 towards the heat plate 67 are installed inside the accommodation space 77.

The ceramic heater 69 is installed in between the heat plate 67 and the magnet plate 71 inside the accommodation space 77 along the backside of the reformation plane 87 to conduct heat to the heat plate 67.

The ceramic heater 69 has a rectangular form and it is heated to maximum 180 degree Celsius for the purpose of conducting heat to the heat plate. It is electrically connected to the power supply code 3.

The magnet plate 71 is formed to be a rectangle and made of neodium magnet of 15,000 gauss. The magnet plate 71 is placed so that South poles of the magnet or North poles of the magnet are faced each other. Or a South Pole and North Pole of the magnet can be faced each other. The magnet plate can be exemplified by not only the permanent magnet as stated above but also electric magnet or combination of permanent magnet and electric magnet. It is favored that the magnet plate is more than 10,000 gauss.

The magnet pushing member 73 configured with a board spring pushes the magnet plate 71 and the ceramic heater 69 towards the reformation plane 87 to contact them without space and to hold them steady. The spring coefficient of the spring 73 configuring the magnet pushing member 73 is set at an extent of not bending itself by the magnet repulsion force when the South poles of the magnet plate 71 are faced each other.

The reformation plates pushing member E is comprised of a plurality of coil springs 1*e* and 2*e*. A plurality of coil springs e configuring the reformation plates pushing member E is placed on the top plane 88 and at the corners of the back side of the reformation plane 87 at one end of coil and is placed at the slit 8 installed inside the top side 29 of the holding arm.

As stated above, the reformation plane 87 of the reformation plate 11 is formed almost rectangle. The coil springs 1*e* and 2*e* configuring the elastic bodies are placed on each corner of the reformation plate. Therefore the lines between the coil spring positions form a parallelogram. Thus the contact pressure of the pair of the reformation planes 87 facing each other can be easily controlled to be uniform over the entire plane. As a result, unevenness of ironing caused of a partial contact can be prevented.

Figure 8A:
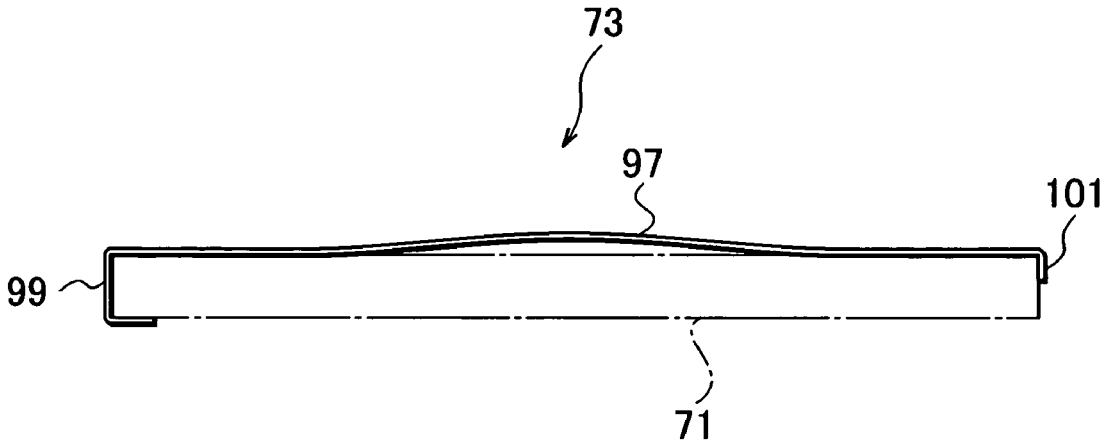
FIG. 8A is a side view of a magnet urging spring of the device shown in FIG. 1.
Figure 8B:
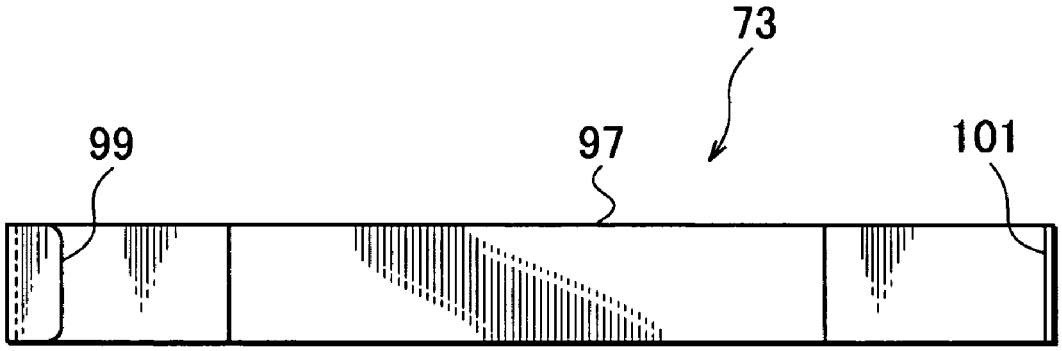
FIG. 8B is a bottom view of a magnet urging spring of the device shown in FIG. 1.
Figure 9A:
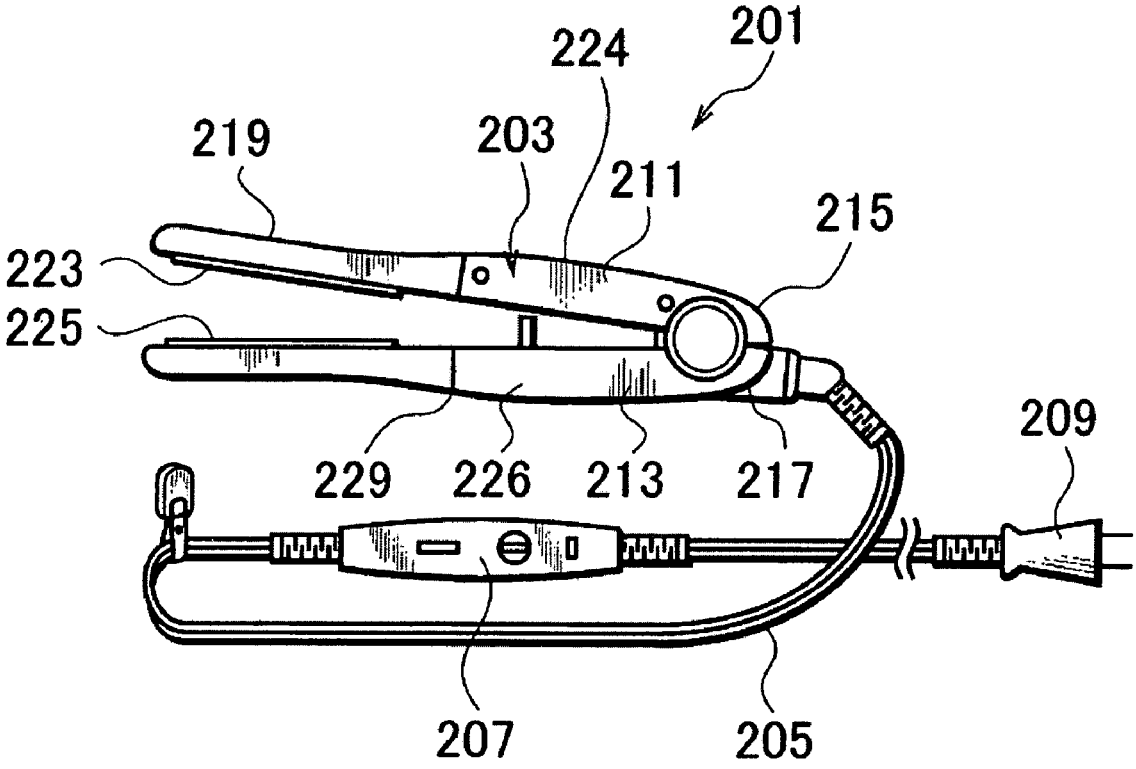
FIG. 9A is an entire view of a prior art.
Figure 9B:
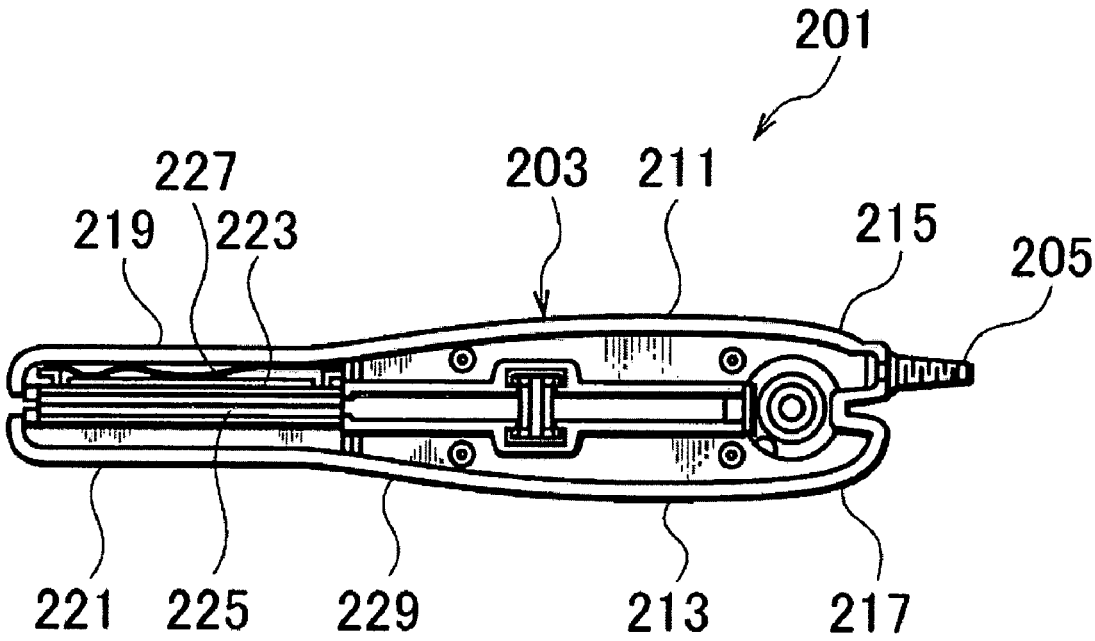
FIG. 9B is a cross-sectional view of the device shown in FIG. 9A.

As shown in FIG. 8, the magnet plate pushing member 73 is comprised of the board spring. A curve 97 is formed at a center of the board spring 73 and also a bending part 99 and a key part 101 are formed at each end of the board spring 73. The magnet plate 71 is held by the board spring 73 at the bending part 99 and the key part 101.

A process of straightening either natural or artificial curl of hair by the hair iron 1 is explained next.

A first liquid solution made of mercapto compound (reductant) such as thioglycolic acid or cysteine as base compound formed as liquid solution and added basic material such as ammonia, mono ethanolamine or triethanol amine and etc. to control its pH from six to ten is applied to hair. Disulfide bond of cystine included in Keratine protein of hair is reduced and cut as mercapto groups by the application of the first liquid solution. Then hair is washed by water and dried by hair drier. Lastly the heated hair iron 1 at its temperature from 140 to 180 degree Celsius is used to straighten the above processed hair.

To straighten, hair is held at the reformation plane 87 in between the heat plates 67 of the reformation plate 11 and 13 by holding hand-hold part 21 and 23 by hand with a thumb and an index finger attached to the emphasis points 25 and 27. Then the holding arms 7 and 9 are slid towards the end of hair keeping contact with the hair iron. As a result hair is smoothed out with the heat plate 67 heated by the ceramic heater 69.

After the above process, a second liquid solution made of oxidant such as sodium bromate or hydrogen peroxide is applied. As a result, the mercapto groups are oxidized and new disulfide bonds are produced of hair and straightened hair is fixed.

During the course of the process, if South poles of the magnet plates 71 or North poles of the magnet plates are faced each other, the magnet plates 71 becomes parallel by the magnet repulsion force and also shrink of the reformation plate pushing member E when the reformation plates 11 and 13 are closed together by holding action of the holding arms 7 and 9. As a result the reformation plates 7 and 9 are also facing parallel at the reformation plane 87 automatically. Thus when the reformation plates 11 and 13 are contacted at reformation plane 87, it is done together over the entire reformation plane 87 by proceeding of the holding action.

If a North pole and a South pole of the magnet plate are faced each other, the magnet plates 71 becomes parallel by the magnet attracting force and also stretch of the reformation plate pushing member E when the reformation plates 11 and 13 are closing together. Thus when the reformation plates 11 and 13 are contacted each other at the reformation plane 87, the contact is done together over the entire reformation plane 87 by proceeding of the holding action.

As stated above, this parallel contact of the reformation plates 11 and 13 prevents unevenness of hair ironing by partial contact of the reformation plane 87.

If a North pole and a South pole are faced each other, holding action may result a sudden contact of the reformation plate 11 and 13. But as the reformation plate pushing member E alleviates the sudden stretch, the proper hair straightening operation is achieved.

Moreover the ceramic heater 69 is installed in between the heat plate 67 and the magnet plate 71 inside the accommodation space 77 along the backside of the reformation plane 87 to conduct heat to the heat plate 67. Heat generated by the ceramic heater 69 is efficiently conducted to the heat plate 67 because of pushing action by spring force of the spring 73.

This invention is not limited to the above example 1. For example, it can be possible to fix one or both of plates 11 and 13 to the top side 29 and 31 of the arms. It can be possible to install only one magnet plate in either of the reformation plate 11 or 13 and the other side can be exemplified by a magnetic body panel. The spring 73 can be omitted.

In this example, the hair iron 1 comprises of a pair of holding arms 7 and 9 pivotally articulated at one end, operating holding action by grasping the hand hold part placed in the center of the holding arms 7and 9, and the reformation plates 11 and 13 placed on the top side of the two arms with their reformation plane 87 facing each other for straightening hair to hold hair in between the reformation plates 11 and 13 at the reformation plane 87 with heat added by the heat plate 67. The reformation plates 11 and 13 are movably held on the holding arms 7 and 9 with a plurality of coil springs 1*e* and 2*e*. The plurality of coil springs 1*e* and 2*e* also pushes the reformation plates 11 and 13 each other to their facing direction to control the state of holding hair elastically. Thus the control of the contact pressure and also the control of the uniformity of the contact pressure over the reformation plane 87 can be facilitated.

It can be possible to extend the contact pressure range by placing a magnet at the back side of the heat plate 67 along the reformation plane 87 with co-working force of coil springs 1*e* and 2*e*.

It can be easily facilitated to set the both contact planes 87 parallel before their contact by setting the axis length of the coil springs 1*e* and 2*e*.

It can be possible to prevent unevenness operation of ironing to straighten hair by setting the spring coefficient appropriate.

It can be easily facilitated to control the contact pressure of the reformation plane 87, because the reformation plane 87 is almost rectangle and the coil springs 1*e* and 2*e* are placed at each corner of the reformation plane 87 at the top side of the reformation plates 11 and 13.

The titanium coat at the reformation plane 87 sterilizes the surface of the coating plane and thus it prevents increase of the friction factor of the reformation plane surface caused of the proliferation of miscellaneous germs and keeps good sliding operation.

Lightening of the weight of the hair iron 1 is achieved of aluminum made reformation plates 11 and 13.

The engagement shoulders 79 and 81 can be contacted at free position.

It can be possible to improve magnetic transparency by adopting the reformation plates 11 and 13 made of stainless or steel.

The hair iron can be exemplified without the magnet plate 71.

What is claimed is:

1. A hair iron, comprising:

a pair of longitudinal holding arms each having first and second holding arm ends, and said holding arms each having an intermediate portion between said first and second holding arm ends, said first holding arm ends being coupled so as to be pivotally movable relative one another, said intermediate portions each having first and second sides on opposing sides of said intermediate portions, said first sides facing each other, said second sides being formed as handle surfaces for engagement by a user to advance said holding arms to a closed position;

a pair of reformation plates disposed on the first sides of said holding arms so as to face each other, said reformation plates having reformation surfaces configured to face each other and hold and reform hair;

heater plates having front sides and back sides, said front sides being respectively applied to interior surfaces of said reformation plates so as to heat said reformation plates to apply heat to the hair via the reformation plates;

a plurality of elastic bodies moveably supporting at least one of the reformation plates on a corresponding one of the first and second holding arms so as to elastically support said at least one of said reformation plates at a neutral bias rest position whereat said plurality of elastic bodies are neither compressed nor expanded by external forces, said at least one of said reformation plates being supported on said first side of said corresponding one of said holding arms at said neutral bias rest position so as to be movable from said neutral bias rest position both toward and away from said corresponding one of said holding arms; and magnets proximate back sides of said heat plates so as to influence flexing of said elastic bodies by one of repulsion or attraction force generated between the magnets so that the reformation plates are caused to advance or retreat from a mounting state absent said force such that mutual attitudes of the reformation plates are correctable.

2. The hair iron as set forth in claim 1, wherein relative positioning between the said reformation surfaces is controlled by the height of the said elastic bodies.

3. The hair iron as set forth in claim 1, wherein a contact pressure between the reformation surfaces is controlled by a spring coefficient of the said elastic bodies.

4. The hair iron as set forth in claim 1, wherein the said reformation surfaces are coated by titanium.

5. The hair iron as set forth in claim 1, wherein the said reformation plates are made of either of aluminum, stainless steel or steel.

6. The hair iron as set forth in claim 1, wherein the reformation surfaces of the said reformation plates are substantially rectangular and the said elastic bodies are placed at respective corners of the said reformation surface of said at least one of the reformation plates.

7. The hair iron as set forth in claim 6, wherein a first pair of said elastic bodies is disposed proximate said second holding arm ends and a second pair or said elastic bodies is disposed distal said second holding arm ends, said first pair of elastic bodies has a first spring coefficient, and said second pair of elastic bodies has a second spring coefficient different from said first spring coefficient.

8. The hair iron as set forth in claim 7, wherein said second spring coefficient is less than said first spring coefficient.

9. The hair iron as set forth in claim 1, wherein said magnets are disposed effect repulsive forces between the reformation plates.

10. A hair iron comprising:

a pair of longitudinal holding arms each having first and second holding arm ends, and said holding arms each having an intermediate portion between said first and second holding arm ends, said first holding arm ends being coupled so as to be pivotally movable relative one another, said intermediate portions each having first and second sides on opposing sides of said intermediate portions, said first sides facing each other, said second sides being formed as handle surfaces for engagement by a user to advance said holding arms to a closed position;

a pair of reformation plates disposed on the first sides of said holding arms so as to face each other, said reformation plates having reformation surfaces configured to face each other and hold and reform hair;

heater plates having front sides and back sides, said front sides being respectively applied to interior surfaces of said reformation plates so as to heat said reformation plates to apply heat to the hair via the reformation plates;

a plurality of elastic bodies moveably supporting at least one of the reformation plates on a corresponding one of the first and second holding arms so as to be biased toward another one of the reformation plates;

magnets proximate back sides of said heat plates so as to influence flexing of said elastic bodies by one of repulsion or attraction force generated between the magnets so that the reformation plates are caused to advance or retreat from a mounting state absent said force such that mutual attitudes of the reformation plates are correctable;

said reformation plates having second interior surfaces opposing said interior surfaces; and heater biasing members respectively applied to said back sides of said heaters so as to bias said heaters toward said interior surfaces of said reformation plates, said heater biasing members being disposed between said back sides of said heaters and said second interior surfaces of said reformation plates so as to apply pressure against said back sides and said second interior surfaces.

11. The hair iron as set forth in claim 10, wherein said heater biasing members are plate springs.

* * * * *